United States Patent [19]

Kaneko et al.

[11] 4,283,474

[45] Aug. 11, 1981

[54] OLEOPHILIC RESIN ENCAPSULATES PHOTOCONDUCTIVE ZINC OXIDE PARTICLES DISPERSED IN VINYL CHLORIDE AND VINYL ACETATE RESIN BINDER FOR ELECTROPHOTOSENSITIVE RECORDING LAYER

[75] Inventors: Tadashi Kaneko; Takeo Shimura; Masanori Matsumoto; Hiroyuki Moriguchi; Hiroyuki Nomori, all of Hachioji, Japan

[73] Assignee: Konishiroku Photo Industry Co., Ltd., Tokyo, Japan

[21] Appl. No.: 188,612

[22] Filed: Sep. 19, 1980

[30] Foreign Application Priority Data

Sep. 25, 1979 [JP] Japan ..... 54-122092

[51] Int. Cl.[3] ..... G03 5/087

[52] U.S. Cl. ..... 430/69; 430/87; 430/89; 430/91; 430/135; 430/90

[58] Field of Search ..... 430/69, 81, 89, 90, 430/96, 135, 91

[56] References Cited

U.S. PATENT DOCUMENTS 3,704,122 11/1972 Yamaguchi et al. ..... 430/87

*Primary Examiner*—John D. Welsh

*Attorney, Agent, or Firm*—Bierman & Bierman

[57] ABSTRACT

An electrophotographic element having a conductive support upon which a coating of oleophilic resin-encapsulated zinc oxide particles, and a sensitizer dispersed in a binder containing vinyl chloride and vinyl acetate polymers is disclosed. Capsule wall can be 5Å to 1μ thick. The oleophilic resin can be silicone, urethane, epoxy.

7 Claims, No Drawings

OLEOPHILIC RESIN ENCAPSULATES PHOTOCONDUCTIVE ZINC OXIDE PARTICLES DISPERSED IN VINYL CHLORIDE AND VINYL ACETATE RESIN BINDER FOR ELECTROPHOTOSENSITIVE RECORDING LAYER

The present invention relates to a photosensitive element for electrophotography, and more particularly to a photosensitive element having a binder-type photosensitive layer.

In general, a photosensitive element for electrophotography of this kind, which is used as a copying master, comprises a photoconductive layer, comprising photoconductive powders dispersed in a binder resin, which is provided directly or through an appropriate inter-layer on a conductive support. Such photosensitive element is loaded onto a transport means in a copying apparatus to be transported along the path in which said photosensitive element is subject to a series of processes for image-formation e.g., a charging process for charging a photoconductive layer of said element, exposure process for imagewise exposing said charged photoconductive layer to form an electrostatic latent image, developing process for developing thus formed electrostatic latent image with toner to form a toner image, transfer process for the transfer of thus formed toner image onto a copying paper, and cleaning process for cleaning the surface of said photoconductive layer after completion of the transfer, and then said photosensitive element is returned to the starting position to prepare for repeated use. And the image thus transferred is then fixed to yield a reproduced image.

As the binder-type photosensitive layer for such photosensitive elements, various kinds have heretofore been suggested and used. Among them as a binder a vinyl chloride-vinyl acetate copolymer and vinyl chloride-vinyl acetate-maleic anhydride copolymer are known as most suitably applicable binder resins. The use of either of the resins can allow a photosensitive element not only to possess extended durability and high receptivity but also to have excellent sensitivity with restrained memory effect.

As photoconductive materials, zinc oxide, titanium exide, selenium, etc. are well known and among them zinc oxide is considered to be one of most preferred ones with the view that it can readily be manufactured inexpensively, is a light weight element oxide, and further is not harmful to any living body including the human body. However, in order to use zinc oxide as a photoconductor for electrophotography, since its inherent sensitivity lies in only ultraviolet region, it is necessary to extend its sensitivity to visible spectra region by adding thereto a sensitizer such as Rosebengal, etc., for spectral sensitization.

From this point of view, a suitable photosensitive element may be obtained when zinc oxide, as a photoconductive material, is dispersed together with a sensitizer in a binder resin containing a copolymer comprising vinyl chloride and vinyl acetate as its copolymeric components to form a photoconductive layer of the element.

However, since the dispersibility of the zinc oxide in the coating liquid is so small that the viscosity of the coating liquid tends to become excessively high, which makes it difficult to carry out coating operation to form the photosensitive layer. Even if the operation is by no means impossible, vacancies in the photoconductive layer tend to increase, which makes the mechanical strength of the layer more vulnerable. This also leads to such problems that the life of the photoconductive element becomes shorter, that electric characteristics such as surface electric potential, dark decay characteristics, etc. may not satisfactorily be obtainable, that sufficient image densities cannot be obtained on the reproduced image. Further, deffective dispersion of zinc oxide particles in the photoconductive layer often results in the deterioration of resolution of reproduced images. For this reason, in practice, a binder resin containing a certain functional group which has an affinity to zinc oxide particles; for example, resins having a hydrophilic functional group such as carboxyl group, hydroxyl group, amino group, etc. are often employed for the purpose of enhancing dispersibility of the particles. However, films made of such resins in general are not very strong and the moisture-resistivity thereof in view of electric characteristics is poor due to the hydrophilic functional group contained therein and therefore, not only the usable life of the photosensitive element will be extremely shortened but also image density is extremely lowered at the time of high humidity, although the problems in the formation of the photosensitive layer and in the image forming characteristics may be improved to a certain extent.

A photosensitive element having a photosensitive layer which uses as a binder a resin comprising a copolymer containing vinyl chloride and vinyl acetate as its copolymeric components still shows a considerable memory effect, if not larger than other resins, and it requires a long period of time for the photoconductive layer, when once exposed to light to restore its conductivity, which has been raised by the exposure, to its initial state of high dark resistance when the layer is put in the dark after the exposure, thus hindering successive high-speed reproductions, leading to a large decline in the image density in a second and subsequent copies compared with the first one when a successive, high-speed copying operation is conducted.

For the purpose of avoiding such a disadvantage, in practice a pre-exposure is usually made prior to making a first copy, which, however, does not essentially remove the foregoing defects of the photosensitive body; this is a procedure devised, noticing that the image densities of successive copies except the first one, though not high, become gradually stable for producing such a condition as if the photosensitive layer substantially experienced a first copying process; i.e., this is nothing more than an apparent solution to the problem.

Further, the formation of a binder-type photosensitive layer containing powdered zinc oxide as an electrophotosensitive material has in general the following drawbacks: The photoconductivity of zinc oxide is produced by the action of active species comprising oxygen atoms such as $O_3$, $O_3^-$, $O_2^-$, etc., and in the dark these active species are adsorbed on the surface of zinc oxide, whereby a number of electrons, which are carriers, on the conduction band of the zinc oxide are trapped to increase the resistance of the zinc oxide. Meanwhile, when exposed to light these active species are desorped to release the electrons, so that the conductivity is increased. In the photographic process it is preferred that prior to commencing the charging process, these active species be restored to the state of being sufficiently adsorbed on the surface of zinc oxide particles to regain the high resistance. However, the case is that this readsorption is not speedily achievable, which causes the foregoing memory effect. In a practical process, these active species are produced by the discharge from the charger in the charging process. Since these active species have large oxidizing power, with the adsorption and desorption thereof the sensitizer and binder resin are rapidly oxidized to be deteriorated, thus shortening the usable life of the photosensitive element, with which the maximum reusable copying number is at most 1,000 or thereabouts. It is substantially impossible, from the above-mentioned principle of action, to remove the atmosphere containing the aforesaid active species from the surroundings of the charger by means of, e.g., air-exhaust.

From the aforementioned point of view, it is an object of the present invention to provide a photosensitive element for electrophotography which has a photoconductive layer wherein photoconductive zinc oxide particles are extremely uniformly dispersed in a binder resin containing a copolymer having vinyl chloride and vinyl acetate as the copolymeric components thereof, and which thus is capable of forming an image with excellent image-quality such as in resolution, without reducing sensitivity.

Another object of the present invention is to provide an photosensitive element for electrophotography which comprises a photoconductive layer wherein photoconductive zinc oxide particles are dispersed in a binder resin containing a copolymer having vinyl chloride and vinyl acetate as copolymeric components, which has a sufficiently high mechanical strength, which is capable of receiving higher potential, which has excellent dark decay characteristics, of which electric characteristics are less likely to be deteriorated under high humidity, and which are highly durable against large number of copying operations, or high maximum number of copies reproducible with the photosensitive element can be extended.

Further object of the present invention is to provide a photosensitive element which has extremely reduced memory effect the degree of which is hardly affected by the surrounding atmosphere around the charger, thus leaving room for extending the life of the photosensitive element and facilitating the designing of the periphery of the charger of electrophotographic copying apparatus which employs the photosensitive element of the present invention.

The above objects of the present invention can be achieved by the use of a photosensitive element which comprises on a conductive support a photoconductive layer comprising photoconductive zinc oxide particles the surface of which has been encapsulated, together with a sensitizer for said zinc oxide, with an oleophilic resin material said zinc oxide particles having been dispersed in a binder resin containing vinyl chloride and vinyl acetate as its copolymeric components.

As will be apparent from what is hereinafter described, since the present photosensitive layer has so little memory effect that a reproduced image with stable density is obtainable from the start of the successive copying operations, and furthermore, successive and high-speed reproduction will be possible. Furthermore, the photosensitive element of the present invention has prolonged usable life since the deterioration by oxidation of the sensitizer as well as of the foregoing binder resin, which has in itself a large copying durability can be effectively prevented leading to the feasibility of an appreciably high maximum number of copying times in an electrophotographic process.

In the present invention, the sensitizer for zinc oxide may be incorporated in the encapsulated photoconductive powders so that the sensitizer is made present between the internal surface of the encapsulating wall material and the surface of zinc oxide particles. Also the sensitizer is incorporated into the capsule wall membrane itself, or it may be present both between the internal surface of the wall material and the surface of the zinc oxide particles and in the wall membrane itself. It is desired that the aforesaid capsule wall membrane substantially covers the entire surface of the single particle of zinc oxide, however, substantially same technical effects can be expected when the wall membrane coveres the entire exposed surface of a group of merged zinc oxide particles, or only a part of the entire surface of a single particle or a group of merged particles of zinc oxide.

The photosensitive element of the present invention may be produced in the following manner: To a solution of the sensitizer powdered photoconductive zinc oxide is added, stirred, filtered and then dried, or the solvent is evaporated to be removed, to produce a sensitized zinc oxide on which the foregoing sensitizer is adsorbed, and thereafter a capsule wall composed of an oleophilic resin material is formed over the surface of the resulting particles. Although the capsule wall may be formed in any procedure, it is preferred that the coacervation method or the in-situ polymerization method be utilized.

According to the coacervation method, for example, the aforementioned sensitized zinc oxide powder is added to the solution of the resin, the material for the wall of the capsule, and then further to this solution a non-solvent which is miscible with the solvent for said solution but does not dissolve the said resin material, or further the said solvent only is evaporated, thereby to reduce the solubility of the said solution in the material resin, and to deposit the material resin onto the surface of the sensitized zinc oxide. In the in-situ polymerization method, the sensitized zinc oxide powder is added to a solution containing a monomer or prepolymer which provides the wall material for the capsule and over the surface of the sensitized zinc oxide particles the said monomer or prepolymer which is under, or is to be under polymerization is deposited. In order to accelerate the formation and the deposit of the monomer or prepolymer by the in-situ polymerization method, various other means e.g., the foregoing coacervation method, heating, stirring, etc. can be employed. A catalist, if needed for the polymerization, may be added to the solution. These methods enable the formation of encapsulated photoconductive particles in which substantially entire surface of the zinc oxide particles is covered with the polymerized resin material of the invention.

The thus produced photoconductive material, since the sensitizer is in advance adsorbed the surface of the zinc oxide particles, is such that the sensitizer is enclosed in between the internal surface of the capsule wall and the surface of the zinc oxide particles. In the case a part of the adsorbed sensitizer is dissolved into the solution containing capsule wall forming material, the photoconductive material becomes such that the sensitizer is also incorporated in the wall membrane.

In addition, it is also possible that the sensitizer is not in advance adsorbed on the surface of zinc oxide particles but is dissolved in the solution containing the capsule wall forming material, in this case adsorption on the surface of zinc oxide particles and incorporation into the capsule wall forming material of the sensitizer will take place concurrently.

There may be used various oleophilic resins for the formation of the capsule wall, the preferred examples of which are silicone resin, urethane resin, silicone modified urethane resin, epoxy resin, silicone modified epoxy resin, etc. It is preferred that the foregoing capsule wall be made of a resin having a three-dimensional reticular structure. In this respect the capsule wall material formed in the previously mentioned manner should preferably be hardened by means of a known method or by the use of any known hardner either during or after formation of the capsule wall material. To achieve this a bridging agent or other means such as heating without the use of any bridging agent may be applied. The thickness of the capsule wall can vary from 5 angstroms to 1 micron, but it is preferably from 10 to 1,000 angstroms, and more preferably from 20 to 100 angstroms.

In the present invention, as the foregoing sensitizer, arbitrary ones may be employed, for example, xanthene dyes such as fluoresceine, erythrocin, froxin, rosebengal, rhodamine blue, etc., triphenyl methane dyes such as bromocresol green, crystal violet, malachite green, etc., acridine dyes such as acridine orange, etc., cyanine dyes such as merocyanine, indoaniline dyes, anthraquinone dyes such as anthraquinone violet, indigo dyes, azo dyes, and others. Of these dyes, compounds having acidic or lactonic structure belonging to xanthene dyes or triphenyl methane dyes are especially favorably because of their high solubility as well as their high capability of being firmly adsorbed on the surface of zinc oxide particles.

The photosensitive element of the present invention is prepared by mixing and dispersing the formed encapsulated photoconductive material in a binder resin hereinafter described together with a solvent therefor to prepare a photosensitive coating composition, which is then coated on a conductive support either directly or through an interlayer coated in advance on the same support and dried to form the photosensitive element of the present invention. The resulting product may be, if necessary, heat-treated. In addition, in its preparation, if, for example, various kinds of silicone oil or fluorocarbons are added to the coating composition, not only the coating ability of the composition due to the increase in the extensibility of the composition but also the toner-filming resistivity owing to these materials contained therein will be improved.

In the present invention, the binder resin is constituted of a copolymer having vinyl chloride and vinyl acetate as the copolymeric components thereof. As such a copolymer a vinyl chloride-vinyl acetate copolymer and a vinyl chloride-vinyl acetate-maleic anhydride copolymer can be mentioned as representative examples.

Hereupon, the vinyl chloride-vinyl acetate copolymer is a resin obtained by polymerizing vinyl chloride monomer with vinyl acetate monomer, having following formula [I];

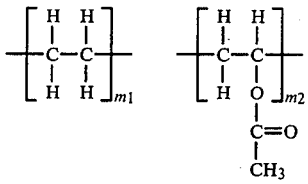

[I]

wherein, $m_1$ and $m_2$ each represents polymerization percentage providing $m_1+m_2=100$.

The vinyl chloride-vinyl acetate copolymer may be classified as various types according to the content of each component and average polymerization degree. What are preferably applicable to the present invention are those having high vinyl acetate content and low polymerization degree, such as those having vinyl acetate content of from 10 to 15% by weight and average polymerization degree of from 100 to 600, or those having moderate vinyl acetate content and moderate polymerization degree, such as those having vinyl acetate content of from 5 to 10% by weight and average polymerization degree from 700 to 1000.

As examples of such resins which belong to the former, there may be mentioned "S-LEC C" (vinyl acetate content 13% by weight with average polymerization degree 420) manufactured by the Sekisui Chemical Co., Ltd., and as for the latter "Vinylite VYHH" (vinyl acetate content 13% by weight with average polymerization degree 450) manufactured by Union Carbide can be mentioned. But, of course, such resins are not to be limited thereto.

And the vinyl chloride-vinyl acetate-maleic acid anhydride copolymer is a resin obtained by polymerizing vinyl chloride monomer, vinyl acetate monomer and maleic anhydride, having following formula [II];

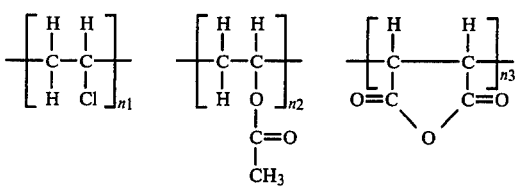

[II]

wherein $n_1$, $n_2$ and $n_3$ each represents polymerization percentage provided $n_1+n_2+n_3=100$.

Most polymers of this type are ones obtained by substituting 1 to 5% by weight of the vinyl acetate component in the vinyl chloride-vinyl acetate copolymer resin of the aforementioned type of high vinyl acetate content with low polymerization degree with maleic acid component examples of which are "S-LEC MF-10" (containing 6.5% by weight of vinyl acetate and 3.5% by weight of maleic anhydride with average polymerization degree of 450) manufactured by the Sekisui Chemical Co., Ltd., and "Vinylite VMCH" (containing 13% by weight of vinyl acetate and 1% by weight of maleic anhydride with average polymerization degree 450) by Union Carbide, but it is needless to say such resins are not limited thereto.

The use of the above copolymers will provide the following advantages: Vinyl chloride resin, though suitable as a binder resin component in view of its excellent physical properties and resistivity against ozone or water this resin is hardly used because of many restrictions accompanied therewith e.g., difficulty in using it as a single binder due to its insolubility in solvents except such extremely strong solvents as tetrahydrofuran, nitrobenzene, etc. While the resin obtained by polymerizing vinyl chloride with a small amount of vinyl acetate is soluble in ordinary solvents such as ketones, e.g., acetone, methyl-ethyl ketone, methyl-isobutyl ketone, etc., dichlorethane, monochlorobenzene, etc. and, therefore, the photoconductive material powder can readily be dispersed in a solution containing said polymer resin and such abovementioned ordinary solvent. Such solution can facilitate the preparation of a coating composition for the formation of the photosensitive element of the present invention. As a result, the photosensitive layer may be provided not only with strongness, ozone- and water-resistivity due to its vinyl chloride component but also with adherence due to its vinyl acetate component, thus yielding a highly durable photosensitive element and thereby enabling to raise the charging potential so high as to form a copy having a sufficiently high image density along with high sensitivity as well as excellent memory characteristics.

In addition, the use of another copolymer further containing maleic anhydride component will improve the electric characteristics of the photosensitive layer to permit to further increase its charging electric potential and sensitivity.

It is preferred in the present invention that the content of such binder resin as mentioned above be at least 50% by weight of the whole binder resin. The other resins may also be used together with the binder resin of the invention. These resins include e.g., silicone resins, acrylic resins, alkyd resins, phenol resin, etc. Such binder resins may be used within the range from 5 to 45 parts by weight, preferably from 15 to 35 parts by weight, most preferably from 20 to 30 parts by weight, to 100 parts of the photoconductive material made of zinc oxide having the previously mentioned capsule wall.

The binder resin containing a copolymer having vinyl chloride and vinyl acetate as its copolymeric components is, as mentioned hereinbefore, capable of restraining the memory effect of photosensitive layers, but according to this invention, the memory effect can be further reduced to become practically negligible by the application of encapsulated zinc oxide photoconductive particles having the capsule wall enclosing a sensitizer therein. Furthermore, the memory effect will little or not at all increase even when the aforementioned oxidizing active species composed of such oxygen atoms as $O_3$, $O_3^-$, $O_2^-$, etc. are eliminated from the periphery of the photosensitive element. Thus a photosensitive element suitable for high-speed successive copying and capable of giving stable copy images with sufficiently high densities is obtained.

In addition, compared to photosensitive elements having conventional photosensitive layers which constitute similar binder resins, the photosensitive element of the present invention has a markedly long usable life and conspicuously increased speed. And in an electrophotographic copying apparatus provided with the photosensitive element of the present invention, when oxidizing active species such as the foregoing oxygen atoms are removed from surrounding atmosphere of the photosensitive element by an appropriate suction ventilator or exhaust fan, further effectively enhanced life would be attainable.

In the present invention, by encapsulating zinc oxide particles with the capsule wall following advantages can be expected. In a conventional photosensitive element provided with zinc oxide, cautions control of properties and kinds of powdered zinc oxide to be used ranging from brands to manufactured lots was essential for the manufacture of a photosensitive element that has desirable and stable characteristics.

The use of the encapsulated zinc oxide photoconductive material in accordance with the present invention can reduce or alleviate various influences upon characteristics of the photosensitive layer to be produced caused by using zinc oxide powder having various different properties such as, difference caused by average diameter of the particle and difference caused by the deviation from stoichiometric relation between zinc-oxygen etc., thus resulting in a photosensitive layer having stable characteristics. Further, according to this invention, since almost all the sensitizer is kept in contact with the surface of zinc oxide particles, it is possible to obtain the sensitization effect with high efficiency, permitting not only to reduce the amount of sensitizer required for gaining the same degree of sensitization but also to prevent the deterioration of the receptibility of the photosensitive element caused by excess accumulation of the sensitizer in the binder resin.

According to the present invention, since the surface of zinc oxide particles are covered by oleophilic resinous capsule wall, so that they can be dispersed rapidly and uniformly as a low viscous dispersion in the solution containing the binder resins as hereinbefore mentioned which are mostly oleophilic. Further, since the uniformly dispersed condition can stably be maintained, photosensitive element wherein said photoconductive material is uniformly dispersed in the photosensitive layer can be obtained. This makes it possible to produce a photosensitive element which can yield reproduced images having excellent resolution.

The photosensitive element of the present invention has a very small memory effect, and this excellent memory characteristics are little or not at all affected even when the aforementioned active species are positively eliminated from the periphery of the photosensitive element. This fact cannot be found in conventional photosensitive element and is quite new to the photographic element of the present invention. The cause of this effect, though it is not necessarily uncertain, is considered that the sensitizer encapsulated by the capsule wall in the state of being in close contact with the surface of zinc oxide particles functions similarly to the oxidizing active species to provide a trapping level on electrons, which act as a number of carriers in the zinc oxide, which, when exposed to light, are released with the movement of charge from the trapping level to the conduction band of the zinc oxide, whereby a photoconductive structure is constituted around the foregoing zinc oxide, and therefore the dark resistance becomes recovered very rapidly as compared with the case of the photoconductive structure constituted by the desorption and adsorption of the foregoing active species accompanied by the movement of such atomic group, and thus such excellent memory characteristics are retained. Another reason assumed is that although the photosensitive element of the present invention also indispensably needs, just as conventional photosensitive elements do, the presence of the aforementioned active species for the development of its photosensitivity, since almost all the active species required for the development of said photosensitivity are substantially encapsulated in the capsule, they can be present, even after getting released from the surface of the zinc oxide particles upon being exposed to light, in the close proximity of the surface of the zinc oxide particles, and as a result, the elements are readsorbed very rapidly upon discontinuation of the projection of light onto the zinc oxide particles, thus extremely reducing the memory effect. In any case the need for dispersion of the active species through the capsule wall or binder resin into the surface of zinc oxide particles is removed, and hence the atmosphere outside the capsule wall now does not influence the development of the photoconductivity of the zinc oxide, nor deteriorate the memory characteristics of the photosensitive element, and thus it has now become possible to prevent each component of the photosensitive element from being injured by the various oxidizing active species by eliminating them from the periphery of the photoconductive element. Thus, together with the effect that deterioration of the sensitizer by oxidation is effectively prevented by encapsulation of the sensitizer within the capsule prolongation of usable life time of the photosensitive element can be achieved.

In the present invention any of conventionally known and used material can be used as the conductive support.

The present invention is further illustrated with reference to examples, but it is needless to say the embodiments of the present invention are not limited thereto.

EXAMPLE 1

0.5 g of Free acid Rosebengal, obtained by acid decomposition of ordinary disodium salt of Rosebengal, was dissolved in 100 ml of methyl-ethyl ketone. To the resulting solution, 100 g of powdered photoconductive zinc oxide which was dried under reduced pressure at the temperature of 120° C. was added to be dispersed for an hour by means of a ball mill, and then the methyl-ethyl ketone was evaporated to produce a sensitized zinc oxide in the powder form on the surface of which the Rosebengal is adsorbed.

The resulting sensitized zinc oxide powder was mixed in the mixture of 170 ml of methyl-ethyl ketone with 30 ml of isoparaffiun "ISOPAR-H" (manufactured by the Esso Petrochemical Co., Ltd.) which is a non-solvent for the hereinafter described silicone epoxy varnish. Further, 2.2 g of silicone epoxy varnish "ES 1001N" (manufactured by the Shin-etsu Chemical Industry Co., Ltd.) and 0.3 g of "D-15", the hardener therefor, were added to the above resulting solution to be dispersed therein by means of supersonic wave for an hour. Subsequently the methyl-ethyl ketone was slowly evaporated by means of an evaporator from the dispersed solution to deposit said silicone epoxy varnish over the surface of the foregoing sensitized zinc oxide particles. And after adding 170 ml of said non-solvent "ISOPAR-H", the product was heat-treated for three hours at the temperature of 150° C., and was filtered by means of a glass filter and dried, thus yielding a photoconductive material having capsule wall composed of silicone modified epoxy resin. (The average thickness of the capsule wall membrane was about 50 angstroms,)

| | |
|---|---|
| The thus obtained photoconductive material | 100 g |
| Vinyl chloride-vinyl acetate copolymer resin resin "S-LEC C" (manufactured by the Sekisui Chemical Co., Ltd.) | 25 g |
| Silicone oil "KF 96" (manufactured by the Shin-etsu Chemical Industry Co., Ltd.) | 0.5 g |
| Toluene | 50 ml |

-continued

| | |
|---|---|
| Methyl-isobutyl ketone | 50 ml |

A mixture prepared in accordance with the above prescription was treated with a ball mill for dispersion for an hour to prepare a coating composition for the formation of a photosensitive layer. The resulting coating composition was then coated so as to become 30 g/m$^2$ in coated amount after drying on the 2 micron-thick casein subbing layer formed over an aluminum-laminated polyester film support, and was dried with hot-air at a temperature of 70° C. and was further heat-treated in a dryer at 100° C. for an hour to form a photosensitive layer, thus producing photosensitive element of the present invention, which is referred to as Sample 1.

EXAMPLE 2

| | |
|---|---|
| A photoconductive material prepared in the same manner as Example 1 | 100 g |
| Vinyl chloride-vinyl acetate-maleic anhydride copolymer resin "S-LEC MF-10" (manufactured by the Sekisui Chemical Co., Ltd.) | 25 g |
| Silicone oil "KF 96" (manufactured by the Shin-etsu Chemical Industry Co., Ltd.) | 1.0 g |
| Toluene | 50 ml |
| Methyl-isobutyl ketone | 50 ml |

Another photosensitive element according to the present invention was prepared in the same manner as in Example 1 with the exception that the coating composition was made in accordance with the above prescription. This element is referred to as Sample 2.

EXAMPLE 3

To a solution of 0.5 g of free acid Rosebengal dissolved in the mixture of 150 ml of "ISOPAR-H", 100 g of dried photoconductor zinc oxide powder was added to be dispersed therein by mixing for one hour by means of a ball mill. To the resulting dispersed solution was then further added 1.0 g of silicone polyol "KR 302A" (manufactured by the Shin-etsu Chemical Industry Co., Ltd.) and 0.5 g of polyisocyanate "KR 302B" (manufactured by the same company) to be dispersed therein by means of the ball mill for an hour. Then from the solution, the ethyl acetate was evaporated by a rotary evaporator, and thereafter was added further 150 ml of "ISOPAR-H" and heated for an hour at the temperature of 130° C. Subsequently, solid matter was filtered out of the resulting liquid and dried, thus producing a photoconductive material having capsule wall composed of silicone modified urethane resin containing Rosebengal. (The average thickness of the capsule wall membrane was about 35 angstroms.)

| | |
|---|---|
| The thus obtained photoconductive material | 100 g |
| Vinyl chloride-vinyl acetate-maleic anhydride polymer resin "S-LEC MF-10" (manufactured by the Sekisui Chemical Co., Ltd.) | 20 g |
| Acryl resin "HR-116" (50% by weight solution) (manufactured by the Mitsubishi Rayon Co., Ltd.) | 20 g |
| Silicone oil "KF 96" (manufactured by the Shin-etsu Chemical Industry Co., Ltd.) | 0.5 g |
| Toluene | 50 ml |
| Methyl-isobutyl ketone | 50 ml |

Still another photosensitive element according to the present invention was prepared in the same manner as in Example 1 with exception that the coating composition was prepared in accordance with the above prescription, which is herein referred to as Sample 3.

EXAMPLE 4

100 g of sensitized zinc oxide in the powder form similar to that of Example 1 was added together with 1.5 g of silicone varnish "KR 214" (manufactured by the Shin-etsu Chemical Industry Co., Ltd.) to 200 ml of ethyl acetate. To the resulting dispersed liquid, while stirring, 400 ml of a non-solvent "ISOPAR-H" were added dropwise using a separating funnel, spending two hours, and then the liquid was heated at 100° C. for three hours, from which the solid matter was filtered to be dried under vacuum at the temperature of 100° C. for three hours, thus producing a photoconductive material having capsule wall composed of silicone resin. (The average thickness of the capsule wall membrane was about 35 angstroms.)

| | |
|---|---|
| The thus produced photoconductive material | 100 g |
| Vinyl chloride-vinyl acetate-maleic anhydride copolymer resin "S-LEC MF-10" (manufactured by the Sekisui Chemical Co., Ltd.) | 30 g |
| Silicone oil "KF 96" (manufactured by the Shin-etsu Chemical Industry Co., Ltd.) | 0.5 g |
| Toluene | 50 ml |
| Methyl-isobutyl ketone | 50 ml |

Still further photosensitive element according to the present invention was prepared by treating the above coating composition in the same manner to that of Example 1. This sample is herein referred to as Sample 4.

CONTROL 1

A photosensitive element was prepared in the same manner as in Example 1 with the exception that the sensitized zinc oxide powder as such was used. This sample is herein referred to as Control sample 1.

CONTROL 2

Another photosensitive element was prepared in the same manner as in Example 1 with the exception that 50 g of acryl resin "HR-112" (50% by weight solution) (manufactured by the Mitsubishi Rayon Co., Ltd.) was used as the binder resin component in the prescription for the coating liquid for the formation of the photosensitive layer. This sample is herein referred to as Control sample 2.

Copying tests and charging tests were conducted on each of the thus prepared samples and control samples. In the tests, running tests were made by loading the foregoing test samples or control samples in an electrophotographic copier "U-BiX 1500" (manufactured by the Konishiroku Photo Industry Co., Ltd.), and measurements were made on the maximum image densities, Dmax, of the respective and control sample copy sheets, one each of them picked at each time of the 1st, 2,000th, 5,000th and 10,000th copying operations. Evaluations were also conducted on the background fog and roughness on the surface of their copies for determining the image quality of these samples. As for the ones of the first copying operation, tests on their resolution capabilities were also conducted. The results of these tests are shown in Table 1.

Further, in the charging tests, each of samples or control samples was loaded in an electrophotocopying tester SP-428 (manufactured by the Kawaguchi Electric Works, Ltd.) to be charged with electricity on its photosensitive layer by charging for 5/7 second with 6 KV of impressed voltage on its discharge electrode, dark decyed for 5 seconds, and then exposed to light; this chain of procedures were repeatedly applied to the photosensitive element in the respective stages before copying operation, after 2,000 copyings, 5,000 copyings and 10,000 copyings, for which measurements were made on the surface electric potential Vo (volt) of the photosensitive layer after dark decay and the half-reducing exposure $E_{\frac{1}{2}}$ (lux, second), i.e., the exposure required for reducing by half the surface electric potential Vo, along with the measurement on the electric potential restoration ratio m (%), i.e., the ratio between the Vo in the first copying operation and that in the second operation.

Still further, the smoothness (mmHg) on the surface of the photosensitive layer was measured by the use of SMOOSTER SM-6B (manufactured by the Toei Electronic Industry Co., Ltd.)

The results of these tests are shown in Table 2.

TABLE 1

| Operation | Testing item | Sample 1 | Sample 2 | Sample 3 | Sample 4 | Control 1 | Control 2 |
|---|---|---|---|---|---|---|---|
| 1st | Resolution | More than 8.0 | More than 8.0 | More than 8.0 | More than 8.0 | 6.3 | 8.0 |
| | D max | 1.2 | 1.2 | 1.3 | 1.2 | 1.1 | 1.0 |
| | Roughness | None | None | None | None | None | None |
| | D max | 1.1 | 1.2 | 1.3 | 1.1 | 0.7 | 0.8 |
| 2,000th | Background fog | None | None | None | None | Much | A little |
| | Roughness | None | None | None | None | A little | None |
| | D max | 1.0 | 1.1 | 0.9 | 0.8 | 0.3 | 0.6 |
| 5,000th | Background fog | None | None | None | None | Too much | Much |
| | Roughness | None | None | None | None | Much | A little |
| | D max | 0.7 | 0.8 | 0.7 | 0.6 | — | 0.3 |
| 10,000th | Background fog | None | None | None | A little | — | Too much |

TABLE 1-continued

| Operation | Testing item | Sample 1 | Sample 2 | Sample 3 | Sample 4 | Control 1 | Control 2 |
|---|---|---|---|---|---|---|---|
| | Roughness | None | None | None | None | — | Much |

Note:
In the table, the data of "resolution" is shown in terms of lines/mm.

TABLE 2

| Operation | Testing item | Sample 1 | Sample 2 | Sample 3 | Sample 4 | Control 1 | Control 2 |
|---|---|---|---|---|---|---|---|
| Before copying | $-Vo$ | 350 | 370 | 400 | 390 | 320 | 360 |
| | $E\frac{1}{2}$ | 3.8 | 3.8 | 3.2 | 3.0 | 3.0 | 4.0 |
| | m | 87 | 91 | 93 | 90 | 72 | 82 |
| After 2,000 copyings | $-Vo$ | 330 | 360 | 390 | 330 | 250 | 320 |
| | $E\frac{1}{2}$ | 3.7 | 3.9 | 3.6 | 3.4 | 6.7 | 4.8 |
| After 5,000 copyings | $-Vo$ | 320 | 350 | 370 | 310 | 200 | 250 |
| | $E\frac{1}{2}$ | 4.0 | 4.3 | 3.8 | 4.2 | 14.5 | 6.0 |
| After 10,000 copyings | $-Vo$ | 300 | 340 | 330 | 270 | — | 150 |
| | $E\frac{1}{2}$ | 4.8 | 4.5 | 4.2 | 5.0 | — | 8.5 |
| Smoothness | | 450 | 400 | 370 | 410 | 750 | 400 |

As is apparent from these tables, the photosensitive element of the present invention is capable of not only withstanding a vast number of copyings but also forming excellent, quality copy images, and particularly the copied images obtained therefrom show fairly high resolution. Further, as is obvious from the value of electric potential restoration ratio m, the surface electric potential Vo obtained by the second charging becomes only slightly lower than that by the first charging, thus the memory effect is extremely small.

In addition, all the copied images in the first copying operation show no background fogs. And the charging and copying operations at the 10,000th copying of Control 1 were unable to be carried out.

Meanwhile, the charging/discharging electrode and the image transfer discharging electrode of the electrophotographic copier were provided therearound with a suction ventilator. Sample 1 and control sample 1 were applied respectively to the two actual electrophotographic processes; one is where the socalled ionic wind is positively exhausted while the other is not, and the values of charged electric potential $-V_1$ obtained in the 1st copying process and $-V_{10}$ in the 10th copying process after sequential copyings with respect to both the cases were measured with the probe provided inside the copying apparatus. Also the maximum densities Dmax 1 and Dmax 10 with respect to the images reproduced in the first and 10th copying processes were measured. The results are shown together with the values of $(-V_{10}/-V_1)\times 100$ and $(\text{Dmax } 10/\text{Dmax } 1)\times 100$ in Table 3.

TABLE 3

| Item | Sample 1 Exhausted | Sample 1 Not exhausted | Control 1 Exhausted | Control 1 Not exhausted |
|---|---|---|---|---|
| $-V_1$ | 350 | 370 | 280 | 340 |
| $-V_{10}$ | 330 | 360 | 140 | 310 |
| $\left(\frac{-V_{10}}{-V_1}\right)\times 100$ | 94 | 97 | 50 | 91 |
| Dmax 1 | 1.2 | 1.3 | 0.9 | 1.2 |
| Dmax 10 | 1.15 | 1.3 | 0.4 | 1.0 |
| $\left(\frac{\text{Dmax } 10}{\text{Dmax } 1}\right)\times 100$ | 96 | 100 | 44 | 83 |

It will be understood from Table 3 that the photosensitive body of the present invention functions almost the same regardless of whether or not ionic wind is exhausted.

We claim:

1. A photosensitive element for electrophotography which comprises on a conductive support a photoconductive layer comprising photoconductive zinc oxide particles the surface of which particles has been encapsulated, together with a sensitizer for said zinc oxide, with an oleophilic resin material, said encapsulated zinc oxide particles having been dispersed in a binder resin containing vinyl chloride and vinyl acetate as components thereof.

2. A photosensitive element according to claim 1, wherein said binder resin contains as a main ingredient vinyl chloridevinyl acetate copolymer or vinyl chloride-vinyl acetate maleic acid unhydride copolymer.

3. A photosensitive element according to claim 1 or 2, wherein said oleophilic resin material has a three dimensional reticular structure.

4. A photosensitive element according to claim 3, wherein said oleophilic resin material has as capsule wall membrane a thickness of 5 angstroms to 1 micron.

5. A photosensitive element according to claim 3, wherein said oleophilic resin material has as capsule wall membrane a thickness of 20 to 100 angstroms.

6. A photosensitive element according to claim 1 wherein said oleophilic resin material is one selected from the group consisting of silicone resin, urethane resin, silicone modified urethane resin and epoxy resin.

7. A photosensitive element according to claim 1 wherein said sensitizer is free acid Rosebengal.

* * * * *